US005217075A

United States Patent [19]

Wittrisch

[11] Patent Number: 5,217,075

[45] Date of Patent: Jun. 8, 1993

[54] METHOD AND DEVICE FOR CARRYING OUT INTERVENTIONS IN WELLS WHERE HIGH TEMPERATURES PREVAIL

[75] Inventor: Christian Wittrisch, Rueil-Malmaison, France

[73] Assignee: Institut Francais Du Petrole, Rueil Malmaison, France

[21] Appl. No.: 789,895

[22] Filed: Nov. 12, 1991

[30] Foreign Application Priority Data

Nov. 9, 1990 [FR] France ..... 90 14018

[51] Int. Cl.[5] ..... E21B 23/08; E21B 36/00; E21B 47/00

[52] U.S. Cl. ..... 166/302; 166/57; 166/382; 166/385

[58] Field of Search ..... 166/302, 57, 65.1, 242

[56] References Cited

U.S. PATENT DOCUMENTS

| | | | |
|---|---|---|---|
| Re. 32,336 | 1/1987 | Escaron et al. | 166/250 |
| 4,064,939 | 12/1977 | Marquis | 166/253 |
| 4,168,747 | 9/1979 | Youmans | 166/250 |
| 4,440,219 | 4/1984 | Engelder | 166/57 |
| 4,457,370 | 7/1984 | Wittrisch | 166/250 |
| 4,498,532 | 2/1985 | Mason | 166/70 |
| 4,690,214 | 9/1987 | Wittrisch | 166/65.1 X |
| 4,729,429 | 3/1988 | Wittrisch | 166/65.1 |
| 4,794,791 | 1/1989 | Wittrisch | 73/151 |
| 4,872,507 | 10/1989 | Ronco, Sr. | 166/57 |
| 4,898,240 | 2/1990 | Wittrisch | 166/65.1 X |
| 5,016,716 | 5/1991 | Donovan et al. | 166/57 X |

FOREIGN PATENT DOCUMENTS

| | | |
|---|---|---|
| 0049668 | 4/1982 | European Pat. Off. . |
| 2522059 | 2/1982 | France . |
| 2583815 | 12/1986 | France . |
| 2135719 | 9/1984 | United Kingdom . |

*Primary Examiner*—Stephen J. Novosad
*Attorney, Agent, or Firm*—Antonelli, Terry, Stout & Kraus

[57] ABSTRACT

A well tool such as a measuring sonde is arranged in a protective housing and introduced into a well at the end of a tubing. A retractable latching device fastens the tool to the housing and to an electrical transmission cable. The tubing is connected with a pumping assembly capable of circulating up to the housing a cooling fluid at a temperature lower than the temperature prevailing in the well and the tool is operated by moving the tool out of the housing and by bringing the tool regularly back into the housing, which is permanently cooled by the fluid.

10 Claims, 2 Drawing Sheets

METHOD AND DEVICE FOR CARRYING OUT INTERVENTIONS IN WELLS WHERE HIGH TEMPERATURES PREVAIL

BACKGROUND OF THE INVENTION

The present invention relates to a method for carrying out various interventions by means of measuring tools or instruments in very deep wells where temperatures high enough to be likely to damage the intervention equipment which is introduced therein prevail.

In the French patent 2,501,777, a method and a device for carrying out various intervention and/or measuring operations in a well, at least part of which is more or less inclined in relation to the vertical, are described. A well tool which can be included in a protective housing is fastened to the end of a rod. The tool is taken down into the well and pushed into the intervention zone by a tubing formed by successively interconnecting a series of additional rods with the first rod. The sonde is connected to a surface installation by a multicore cable whose interconnection is delayed until the tool reaches a given depth. The cable is fitted with a socket connector which can be plugged in a liquid medium and which is introduced within the tubing through a special side-entry sub. The connector is pushed forward until it plugs into a contact plug fastened to the tool. When the tool has been pushed into a predefined intervention zone, it is disengaged from the tubing and/or, if need be, it is driven out of the protective housing under the pressure of a current of drilling fluid established in the tubing or simply under the action of the force of gravity if the inclination of the well allows it. An analogous well tool, protected from the shocks which may occur during the translation thereof in a well by a housing, is also described in French patent 2,583,815.

It is well-known that the temperature prevailing in wells rises very substantially with the depth. In very deep wells drilled as far as 5, 10 km or even more, the temperature very often exceeds 200° C. Most of the intervention tools and/or the measuring sondes which are conventionally used in wells are unsuited for working in this temperature range.

In the French addition certificate 2,522,059 associated with French patent 2,501,777 heretofore described, a method for driving into a deflected zone of a well, an intervention tool such as a sonde arranged in an open housing which can provide a thermal protection by circulating a fluid in the tubing which is used for driving the tool down into the intervention zone is described.

SUMMARY OF THE INVENTION

The object of the present invention is to provide a method for carrying out intervention operations by means of an intervention tool such as a logging sonde, for example, in a deflected well in zones thereof where a high temperature likely to damage the sonde prevails, this method combining operating stages where the sonde carries out measurings with stages where the sonde momentarily returns into a protective housing to be cooled in contact with a fluid current circulating in a tubing.

The method according to the invention comprises setting a tool in the protective housing adapted for containing the tool totally, the housing being immovably attached to the end of a tubing; linking the tool to the protective housing by means of a support frame fitted with a first plug and with first retractable means for latching the support frame to said housing; using a cable fitted at the end thereof with a second plug complementary of the first plug and adapted to be plugged into the first plug in a delayed way in a wet medium in order to connect the tool in the well to a surface installation, and with second retractable means for fixing the second plug to said frame support; and connecting the upper end of the tubing with a pumping assembly capable of delivering into the housing a cooling fluid at a temperature lower than the temperature prevailing in the well in the zone of intervention of the tool.

The method according to the invention in order to have a tool work in well zones where prevailing high temperatures are likely to damage the tool further comprises: connecting the tool with a surface installation by a cable, bringing the tool into the cooled housing thereof by means of said fluid as far as the end of the intervention zone which is the furthest from the surface, and progressively removing the tubing and carrying out interventions with the tool by taking out of the housing and by periodically driving the tool back into the cooled housing in order to lower the temperature thereof.

According to a preferred embodiment procedure, a fluid circulation is established in order to cool a total portion of the well close to the housing so that the tool permanently moves within a cooled working zone.

The tool is preferably positioned in a housing having a length sufficient for cooling a well zone in front of the during the stage of lowering the tool towards the intervention zone.

It is also possible in certain cases to establish a nearly permanent fluid circulation during the stages of moving of the tool towards the intervention zone and of withdrawing of the tool from this zone.

The device for the implementing the method comprises a tubing, a protective housing fastened to the end of the tubing and adapted to contain totally the tool, a support frame for the tool, the frame being fitted with first retractable means for latching the support frame to the housing and with a first plug, a cable fitted with a second plug adapted to be plugged and locked into the first plug in a delayed way in a wet medium, in order to connect the tool with a surface installation. It comprises thermal insulation means associated with the tubing in order to limit the heat exchanges between the inside and the outside of said tubing.

According to an implementing procedure, the device comprises for example stopping means for limiting the stroke of the tool outside the housing.

It can also comprise a special side-entry sub fitted with a central passageway with substantially the same inner section as said tubing, in order to facilitate the circulating of the cooling fluid.

According to an embodiment of the method, the support frame is connected with the tool by a stiff interconnecting rod.

The length of the housing is for example at least equal to the length of the assembly consisting of the tool and the support frame thereof.

With these progressive shiftings of the tubing and the tool, the tool intermittently leaves the thermal protection housing thereof to reach a working zone which has been more or less in contact before with the cooling fluid pumped in the tubing and outside it. The method according to the invention therefore allows to have the tool work in good temperature conditions.

BRIEF DESCRIPTION OF THE DRAWINGS

Other features and advantages of the method and of the device according to the invention will be clear from reading the description hereafter of embodiments given by way of non limitative examples, with reference to the accompanying drawings in which.

DESCRIPTION OF THE PREFERRED EMBODIMENTS

Figure 1:
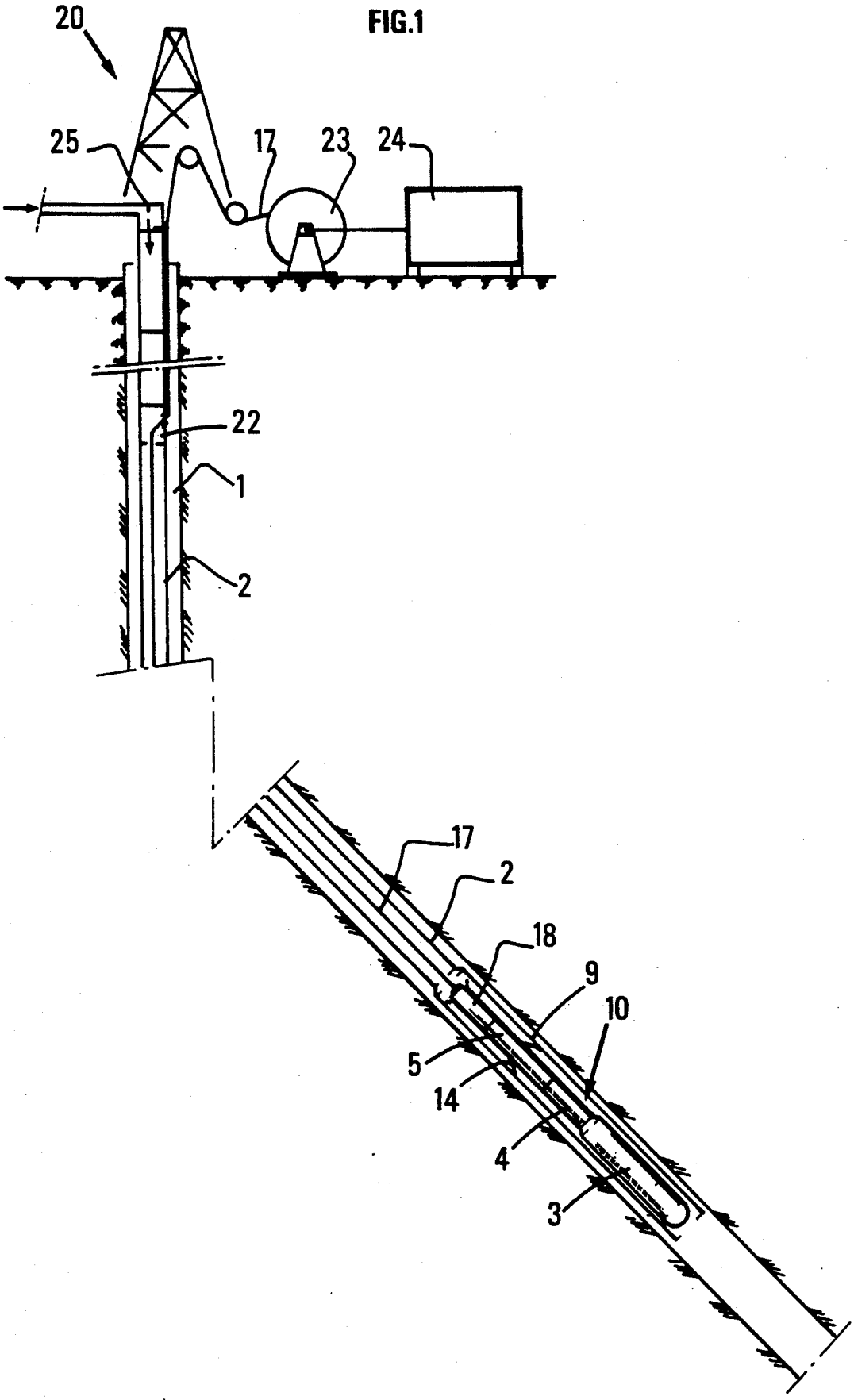
FIG. 1 diagrammatically shows the device for driving into a deep well an intervention tool such as a logging sonde for example.

To carry out interventions at a great depth in a well 1 and notably in a deflected well, a tubing 2 of great length, at the end of which an intervention tool 3 such as a measuring sonde for example is adapted, is taken down (FIG. 1) therein. This intervention tool 3 is fastened (FIG. 2) to a first end of a connecting rod 4. The opposite end of rod 4 is connected with a support frame 5 which comprises on the side of the tubing 2 a tubular extension 6. A multicontact plug 7 is arranged at the centre of this extension and following the axis thereof. A collar 8 with a section greater than the section of extension 6 is fastened to the latter.

Figure 3:
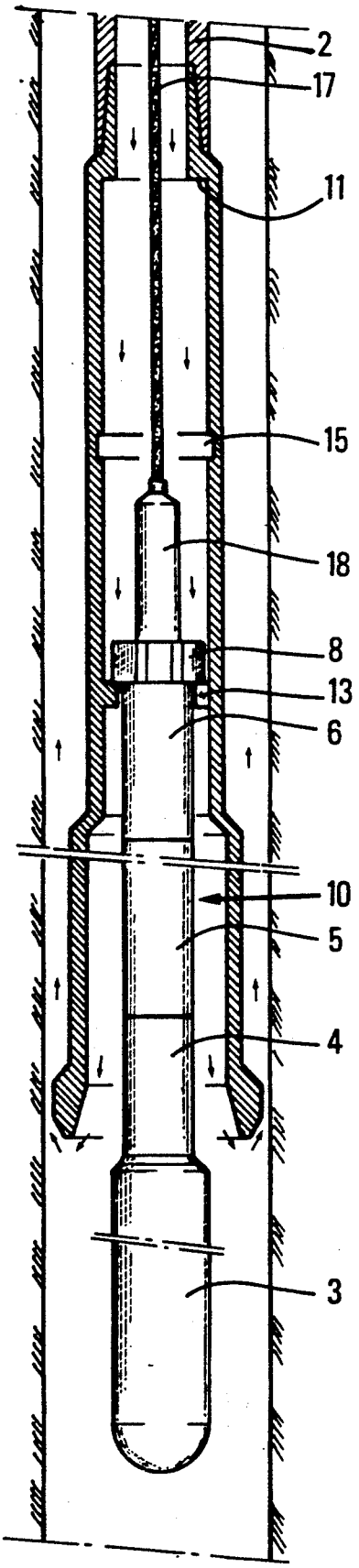
FIG. 3 shows the same tool in a working position outside the housing.
Figure 4:
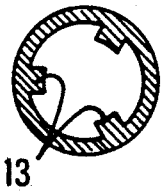
FIG. 4 shows a cross section of the lay-out of the stopping means which facilitate the circulating of the cooling fluid.

A protective housing 9 is fastened to the end of the tubing 2 to contain the movable assembly 10 consisting of the tool 3, the connecting rod 4 and the support frame 5 with the tubular extension 6 thereof. The shape of the housing 9 is adapted according to the different elements of the movable assembly 10 in order to provide an annular space around the assembly sufficient for circulating a fluid current. The housing 9 has a first tubular portion 11 with a section greater than the section of tubing 2, which joins up with the latter through a first shoulder 12 serving as a back dog for the collar 8, which limits the possible shifting back of the movable assembly 10. The housing 9 inwardly comprises a second dog 13 with a section smaller than the section of collar 8 and arranged in order to limit the possible displacement of the movable assembly 10 towards the outside. The displacement can be limited so that only the tool can leave the protective housing 9 as shown in FIG. 3.

The housing 9 can be extended to increase the length of the well zone cooled by the circulating in case of a momentary interruption of the latter, in order to minimize the reheating of the tool as will be shown in the description of the operating method of the device.

Anchoring fingers 14 are mounted pivoted in relation to the support frame 5. Under the action of a motor which is not shown, the fingers 14 can be moved away until they reach an open position (FIG. 2) where they are locked in a groove 15 provided in the inner wall of the housing 9, the movable assembly 10 being in a backward position.

Figure 2:
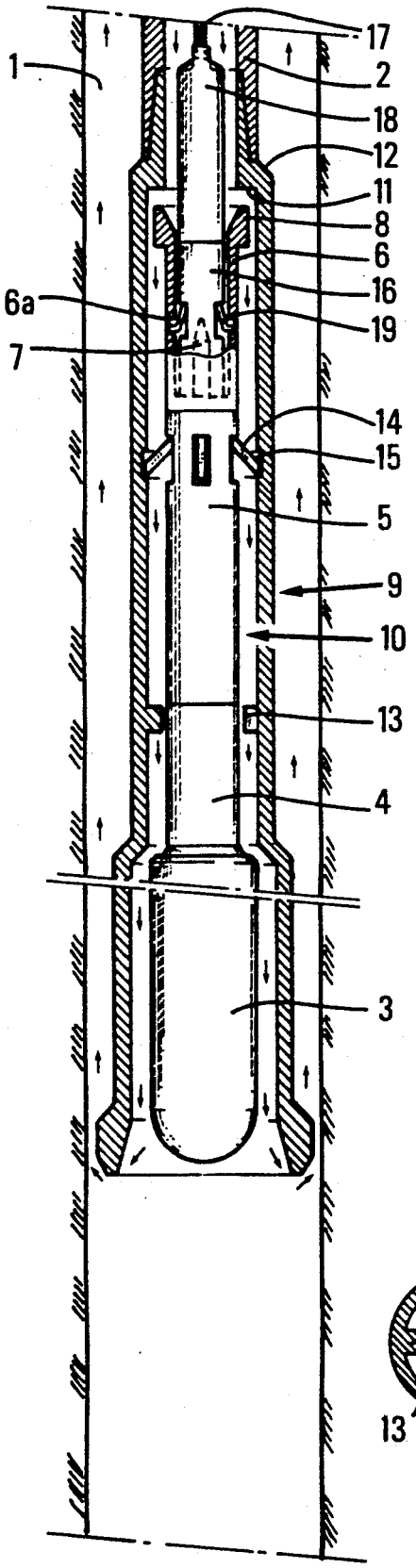
FIG. 2 shows the intervention tool in a housing thereof, in a shifted back position.

The collar 8 is fitted with a flare in the upper part thereof for guiding towards the bottom of the tubular extension 6 and the contact plug 7 a multicontact socket 16 which can be plugged in a wet medium. This socket 16 is connected with a multiconductor electric-carrying cable 17 and it is preferably topped by a load bar 18 which facilitates the taking down thereof along the tubing. It is fitted with retractable anchoring fingers 19. Motor means which are not shown allow to move away the fingers 19. In the plug-in position of the socket 16, the fingers are locked in an inner groove 6A of the tubular extension 6 and thereby make the cable 17 and the movable assembly 10 interdependent. Through cable 17, the intervention tool and/or the measuring sonde 3 is connected with a surface installation 20 (FIG. 1). The cable 17 coming up from the tool inside tubing 2 passes outside the tubing through the entry of an inserted side-entry sub 22 and it is linked to an operating device 23 on one hand and to a control apparatus 24 suited to the tool used. This apparatus 24 is a control and recording station in the case of a logging sonde for example. The tubing is topped at the surface with a swivel 25 connected with a pumping system (not shown) adapted for establishing a current of drilling fluid under pressure between the inside of the tubing 2 and the annulus between the tubing and the well.

A swivel for example of the type known by specialists as top power drive can be associated with the surface operating apparatus. It goes together with any new rod added to extend the tubing during the taking down thereof in the well or withdrawn from the well in the reverse process of withdrawal of the tubing. The circulation of the cooling fluid can therefore be established in a nearly continuous way.

In the more conventional case where the swivel must be uncoupled from the tubing during the time necessary for the taking down into the well of any newly added rod or during the time of withdrawal of the latter on the way out, the circulation is momentarily interrupted.

The operating procedure is different in either case, as shown in the description of the working of the device.

A tubing 2 consisting of rods thermally insulated by an inner or an outer coating in order to slow down the reheating of the fluid which occurs all along the flowing thereof towards ever warmer zones is preferably used.

A side-entry sub 22 fitted with an axial channel wide enough to facilitate the flow of the current of cooling fluid is also preferably used.

The procedure for driving the sonde towards the bottom of the well is the same as the one which is described in the cited French patent 2,501,777. The tool locked in the housing 9 thereof by the anchoring fingers 14 is taken down into the well 1 by extending tubing 2. After each addition of a new rod and after a more or less long waiting period, according to the type of swivel used, as seen above, the circulation of the fluid is restored. The tool is therefore permanently cooled. When it has been taken to the upper limit of the intervention zone, the side-entry sub 22 is inserted and, through the side-entry thereof, the cable 17 is introduced with the socket connector 16 topped by the load bar 18 thereof. The fluid current makes the socket connector 16 go down until it engages into the tubular extension 6 and into the contact plug 7. The latching of the anchoring fingers 19 is then actuated.

The intervention tool 3 in the housing 9 thereof is driven to the deepest end where interventions are planned. The pumping of cooling fluid is carried on throughout this stage.

The interventions by means of the tool are carried out during the taking up by means of the tool withdrawn from the protective housing thereof through the unblocking of the anchoring fingers (FIG. 3). The tool 3 being held back by the cable, a traction is exerted on the tubing 2 until the collar 8 rests against the lower dog 13. In this position, the tool is sufficiently removed from the housing thereof for the planned intervention. The circulation of the fluid is maintained in order to cool the inside of the housing and the zone of the well close to the open end thereof. If the conditions permit it, the tubing can be taken up at once by the length of a rod. This rod can then be removed. The circulation of the fluid is only interrupted during this operation, if a swivel co-operating with the surface hoisting gear is used.

When the intervention is over, the cable 17 is immediately pulled up in order to bring the tool 3 back into the zone which is permanently cooled by the fluid current and it is kept therein as long as necessary for the bottomhole equipment (the tool 3, the support frame 5 thereof and the connectors 7, 16) to be brought back into the suitable temperature range. The previous process of withdrawal of the tubing to free the tool and of moving back of the tool into the housing is started again preferably after each intervention. In case of a failure in the coming out of the rods from the tubing, it remains possible to bring the tool back into the housing thereof while maintaining the fluid circulation.

In case of a swivel which must be uncoupled from the tubing during the time of total withdrawal outside the well and of disconnection of the rods which have been taken up, the cooling of the intervention tool is nevertheless achieved in good conditions if an extended housing is used. The use of a housing extended by the length of a tubing section for example has the effect of cooling the well zone in front of the intervention tool during the stages of taking down of the tubing. During the relatively short pumping stops (some minutes at the most), the tool moves forward into a well zone that is still cooled and the reheating thereof remains limited. In the same way, during the stage of taking up and of intervention, the shifting back of the tool is actually carried out in a well zone which has been cooled during the previous circulation period, which also minimizes the reheating of the tool.

The fluid coming up to the surface through the annulus between the tubing and the well is cooled before being reinjected towards the bottom. A pumping system with a relatively high output in the region of several $m^3$/mn and reserves sufficient for the fluid permanently reinjected into the tubing to have the time to cool down sufficiently is used. The rate of inflow and the injection temperature are calculated so that, in the planned intervention zone and at the planned intervention depth, and with the string of rods used, the temperature prevailing in the housing remains lower than the limit temperature which can be withstood by the tool. At a depth of about 10 km, the ambient temperature in a well often exceeds 200° C. and, with the method according to the invention, the temperature withstood by the tool can be limited below 150° C. for example by properly selecting the rate of inflow and the injection temperature of the cooling fluid.

I claim:

1. A method for carrying out interventions with a well tool in zones of a deflect well where high temperatures likely to damage the tool prevail, wherein the tool is set in a protective housing adapted to contain the tool totally, the housing being immovably attached to the end of a tubing; the tool is linked to the protective housing by means of a support frame fitted with a first plug and with first retractable means for anchoring the support frame to the housing; an electrical transmission cable fitted at the end thereof with a second plug complementary of the first plug and adapted to be plugged into the first plug in a delayed way in a wet medium in order to connect the tool in the well with a surface installation and with a second retractable means for fixing the second plug to said support frame, and the upper end of the tubing is connected with a pumping system capable of delivering into the housing a cooling fluid at a temperature lower than the temperature prevailing in the well in the zone of intervention of the tool; the method, in order to make the tool work in well zones where high temperature is likely to damage the tool prevail further comprising:

linking the tool to the surface installation by said cable, bringing the tool into the housing thereof cooled by said fluid, as far as the end of the intervention zone which is furthest from the surface, and progressively withdrawing the tubing and carrying out interventions with the tool by removing the tool from the housing and by periodically driving the tool back into the cooled housing in order to lower the temperature of the tool.

2. A method as described in claim 1, wherein a fluid circulation is established in order to cool down a well portion close to said housing so that the tool permanently moves within a cooled working zone.

3. A method as described in claim 2, wherein the tool is positioned in a housing with a length sufficient for cooling a well zone in front of the tool during movement of the tool towards the intervention zone.

4. A method as described in claim 1 or claim 2, wherein a nearly permanent fluid circulation is established during displacement of the tool towards the intervention zone and withdrawal of the tool from the intervention zone.

5. A device for carrying out interventions with a well tool in zones of a deflect well where high temperatures likely to destroy the tool prevail, which comprises a tubing, a protective housing fastened to the end of the tubing and adapted to contain the tool totally, a support frame for the tool fitted with the first retractable means for anchoring the support frame to the housing and with a first plug, an electrical transmission cable fitted with a second plug adapted to be plugged and locked into the first plug in a delayed way in a wet medium in order to connect the tool with a surface installation, thermal insulation means associated with the tubing to limit the heat exchanger between the inside and outside of said tubing and the upper end of the tubing being connected with a pumping system capable of delivering into the housing a cooling fluid at a temperature lower than the temperature prevailing in the well in the zone of intervention of the tool.

6. A device as claimed in claim 5 further comprising stop means for limiting the movement of the tool outside the housing.

7. A device as claimed in claim 5 or claim 6 further comprising a side-entry sub fitted with a central passageway with substantially the same inner cross section as said tubing in order to facilitate circulation of the cooling fluid.

8. A device as claimed in claim 7, wherein the support frame is connected with a tool through a stiff interconnecting rod.

9. A device as claimed in claim 8, wherein the length of the housing is at least equal to the length of an assembly consisting of the tool and the support frame thereof.

10. A device as claimed in claim 9, wherein the length of the housing is greater than the length of an assembly consisting of the tool and the support frame thereof.

* * * * *